US006307510B1

(12) United States Patent
Taylor et al.

(10) Patent No.: US 6,307,510 B1
(45) Date of Patent: Oct. 23, 2001

(54) PATCH DIPOLE ARRAY ANTENNA AND ASSOCIATED METHODS

(75) Inventors: Robert Charles Taylor, Melbourne; James J. Rawnick, Palm Bay, both of FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 09/702,712

(22) Filed: Oct. 31, 2000

(51) Int. Cl.[7] ..... H01Q 1/26

(52) U.S. Cl. ..... 343/700 MS; 343/790; 343/795; 343/830

(58) Field of Search ..... 343/700 MS, 790, 343/792, 793, 794, 795, 799, 829, 830, 846, 850, 853; H01Q 1/26

(56) References Cited

U.S. PATENT DOCUMENTS

| | | | | |
|---|---|---|---|---|
| 3,568,204 | * | 3/1971 | Blaisdell | 343/725 |
| 3,594,810 | * | 7/1971 | Kaloi | 343/848 |
| 3,995,277 | | 11/1976 | Olyphant, Jr. | 343/846 |
| 4,173,019 | | 10/1979 | Williams | 343/700 |
| 4,287,603 | * | 9/1981 | Moser | 455/293 |
| 4,546,358 | * | 10/1985 | Edlin et al. | 343/703 |
| 4,734,660 | * | 3/1988 | Lofgren | 333/21 A |
| 5,389,937 | * | 2/1995 | Kaloi | 343/700 MS |
| 5,477,233 | * | 12/1995 | Hemming et al. | 343/767 |

* cited by examiner

*Primary Examiner*—Tho G Phan
(74) *Attorney, Agent, or Firm*—Allen, Dyer, Doppelt, Milbrath & Gilchrist, P.A.

(57) ABSTRACT

The dual polarization antenna includes a substrate having a ground plane and a dielectric layer adjacent thereto, and at least one antenna unit carried by the substrate. The antenna unit includes four adjacent antenna elements arranged in spaced apart relation from one another about a central feed position on the dielectric layer opposite the ground plane. Preferably, diagonal pairs of antenna elements define respective antenna dipoles thereby providing dual polarization. The antenna unit also includes an antenna feed structure having four coaxial feed lines, each coaxial feed line including an inner conductor and a tubular outer conductor in surrounding relation thereto. The outer conductors have parallel adjacent ends joined together about an axis and are connected to the ground plane. The ends of the outer conductors are tapered and arranged so that portions thereof adjacent the axis extend further beyond the ground plane in the dielectric layer and toward the antenna elements. The inner conductors preferably extend outwardly from ends of respective outer conductors, through the dielectric layer and are connected to respective antenna elements adjacent the central feed position.

39 Claims, 4 Drawing Sheets

PATCH DIPOLE ARRAY ANTENNA AND ASSOCIATED METHODS

FIELD OF THE INVENTION

The present invention relates to the field of communications, and more particularly, to phased array antennas.

BACKGROUND OF THE INVENTION

Existing microwave antennas include a wide variety of configurations for various applications, such as satellite reception, remote broadcasting, or military communication. The desirable characteristics of low cost, light-weight, low profile and mass producibility are provided in general by printed circuit antennas wherein flat conductive elements are spaced from a single essentially continuous ground element by a dielectric sheet of uniform thickness. The antennas are designed in an array and may be used for communication systems such as identification of friend/foe (IFF) systems, personal communication service (PCS) systems, satellite communication systems, and aerospace systems, which require such characteristics as low cost, light weight, low profile, and a low sidelobe.

The bandwidth and directivity capabilities of such antennas, however, can be limiting for certain applications such as space applications. Furthermore, while a microstrip patch antenna is advantageous in applications requiring a conformal configuration, e.g. in aerospace systems, mounting the antenna presents challenges with respect to the manner in which it is fed such that conformality and satisfactory radiation coverage and directivity are maintained and losses to surrounding surfaces are reduced. More specifically, increasing the bandwith of a phased array antenna with a wide scan angle is conventionally achieved by dividing the frequency range into multiple bands. This approach results in a considerable increase in the size and weight of the antenna while creating a Radio Frequency (RF) interface problem. Also, gimbals have been used to mechanically obtain the required scan angle. Again, this approach increases the size and weight of the antenna, and results in a slower response time.

Thus, there is a need for a lightweight patch dipole phased array antenna with a wide frequency bandwith and a wide scan angle, and that can be conformally mountable to a surface.

SUMMARY OF THE INVENTION

In view of the foregoing background, it is therefore an object of the invention to provide a lightweight patch dipole phased array antenna with a wide frequency bandwith and a wide scan angle, and that can be conformally mountable to a surface.

This and other objects, features and advantages in accordance with the present invention are provided by a dual polarization antenna including a substrate having a ground plane and a dielectric layer adjacent thereto, and at least one antenna unit carried by the substrate. The antenna unit includes four adjacent antenna elements arranged in spaced apart relation from one another about a central feed position on the dielectric layer opposite the ground plane. Preferably, diagonal pairs of antenna elements define respective antenna dipoles thereby providing dual polarization. The antenna unit also includes an antenna feed structure comprising four coaxial feed lines, each coaxial feed line comprising an inner conductor and a tubular outer conductor in surrounding relation thereto. The outer conductors have parallel adjacent ends joined together about an axis and are connected to the ground plane. The ends of the outer conductors are tapered and arranged so that portions thereof adjacent the axis extend further beyond the ground plane in the dielectric layer and toward the antenna elements. The inner conductors preferably extend outwardly from ends of respective outer conductors, through the dielectric layer and are connected to respective antenna elements adjacent the central feed position.

Preferably, the ends of the outer conductors are symmetrically angled, and all of the antenna elements have a same shape. The ground plane may extend laterally outwardly beyond a periphery of the antenna unit, and the coaxial feed lines may diverge outwardly from contact with one another upstream from the central feed position. The antenna may also include at least one hybrid circuit carried by the substrate and connected to the antenna feed structure. Each antenna element may have a generally rectangular or a generally square shape. Furthermore, the at least one antenna unit preferably comprises a plurality of antenna units arranged in an array.

The dielectric layer preferably has a thickness in a range of about ½ an operating wavelength of the antenna, and at least one impedance matching dielectric layer may be provided on the antenna unit. This impedance matching dielectric layer may extend laterally outwardly beyond a periphery of the antenna unit. Also, the substrate is preferably flexible.

Objects, features and advantages in accordance with the present invention are also provided by a method of making an antenna including forming a substrate having a ground plane and a dielectric layer adjacent thereto, and providing at least one antenna unit on the substrate. Providing the antenna unit includes arranging four adjacent antenna elements in spaced apart relation from one another about a central feed position on the dielectric layer opposite the ground plane, and forming an antenna feed structure comprising four coaxial feed lines, each coaxial feed line comprising an inner conductor and a tubular outer conductor in surrounding relation thereto, the outer conductors having parallel adjacent ends. Forming the antenna feed structure further comprises joining together the parallel adjacent ends of the outer conductors about an axis, connecting the parallel adjacent ends of the outer conductors to the ground plane, tapering and arranging the parallel adjacent ends of the outer conductors so that portions thereof adjacent the axis extend further beyond the ground plane in the dielectric layer and toward the antenna elements, and connecting the inner conductors to respective antenna elements adjacent the central feed position, the inner conductors extending outwardly from the parallel adjacent ends of respective outer conductors.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
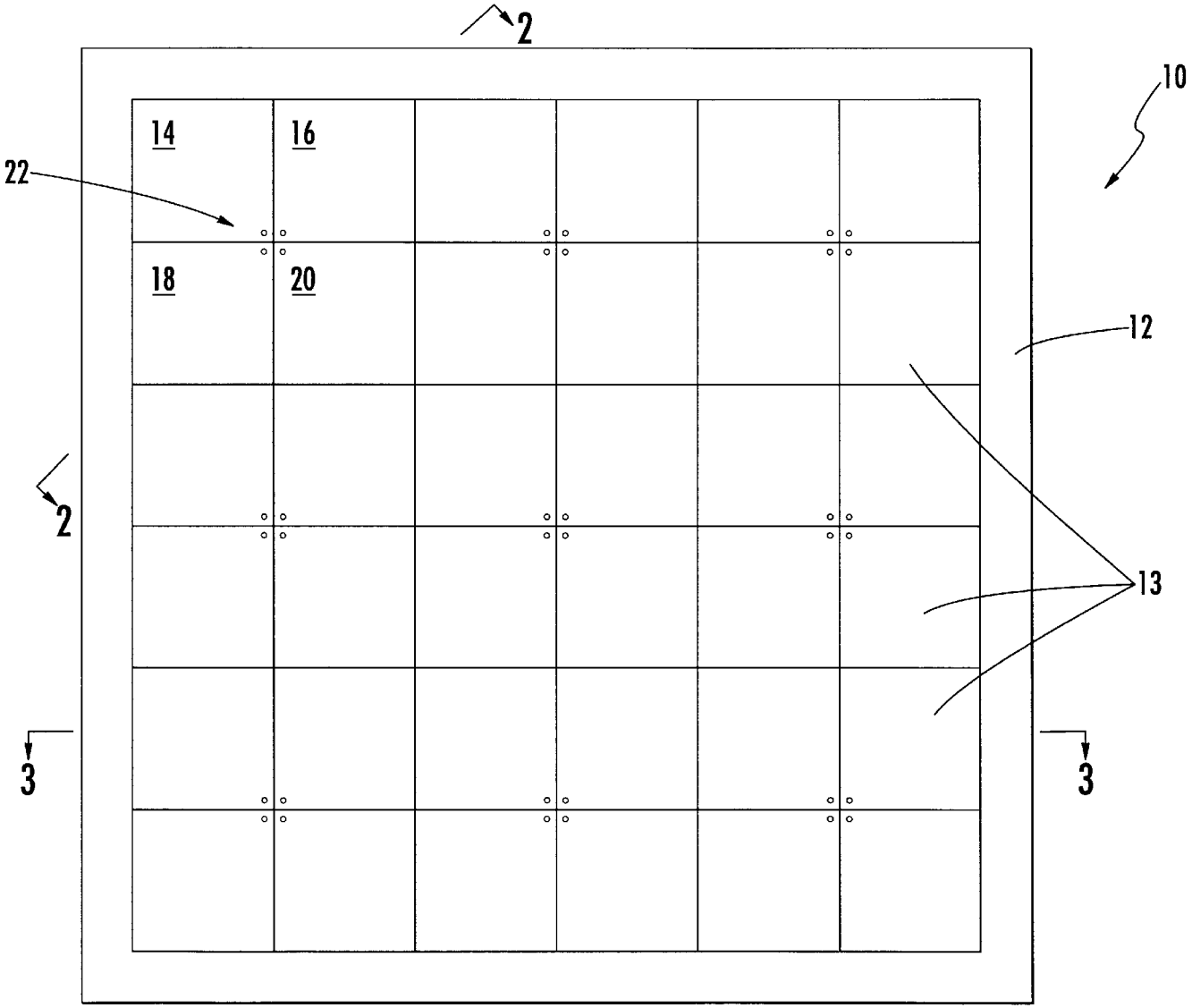
FIG. 1 is a schematic plan view of a dual polarization phased array antenna in accordance with the present invention.

Referring to FIGS. 1–4 a dual polarization antenna 10 will be described. The antenna 10 includes a substrate 12 having a ground plane 26 and a dielectric layer 24 adjacent thereto, and at least one antenna unit 13 carried by the substrate. Preferably, a plurality of antenna units 13 are arranged in an array. As shown in FIG. 1, the antenna 10 includes nine antenna units 13. Each antenna unit 13 includes four adjacent antenna patches or elements 14, 16, 18, 20 arranged in spaced apart relation from one another about a central feed position 22 on the dielectric layer 24 opposite the ground plane 26. Preferably, diagonal pairs of antenna elements, e.g. 16/18 and 14/20, define respective antenna dipoles thereby providing dual polarization as would be appreciated by the skilled artisan. Of course, only a single pair of antenna elements, e.g. 16/18, forming an antenna dipole may be provided for a single polarization embodiment.

Figure 2:
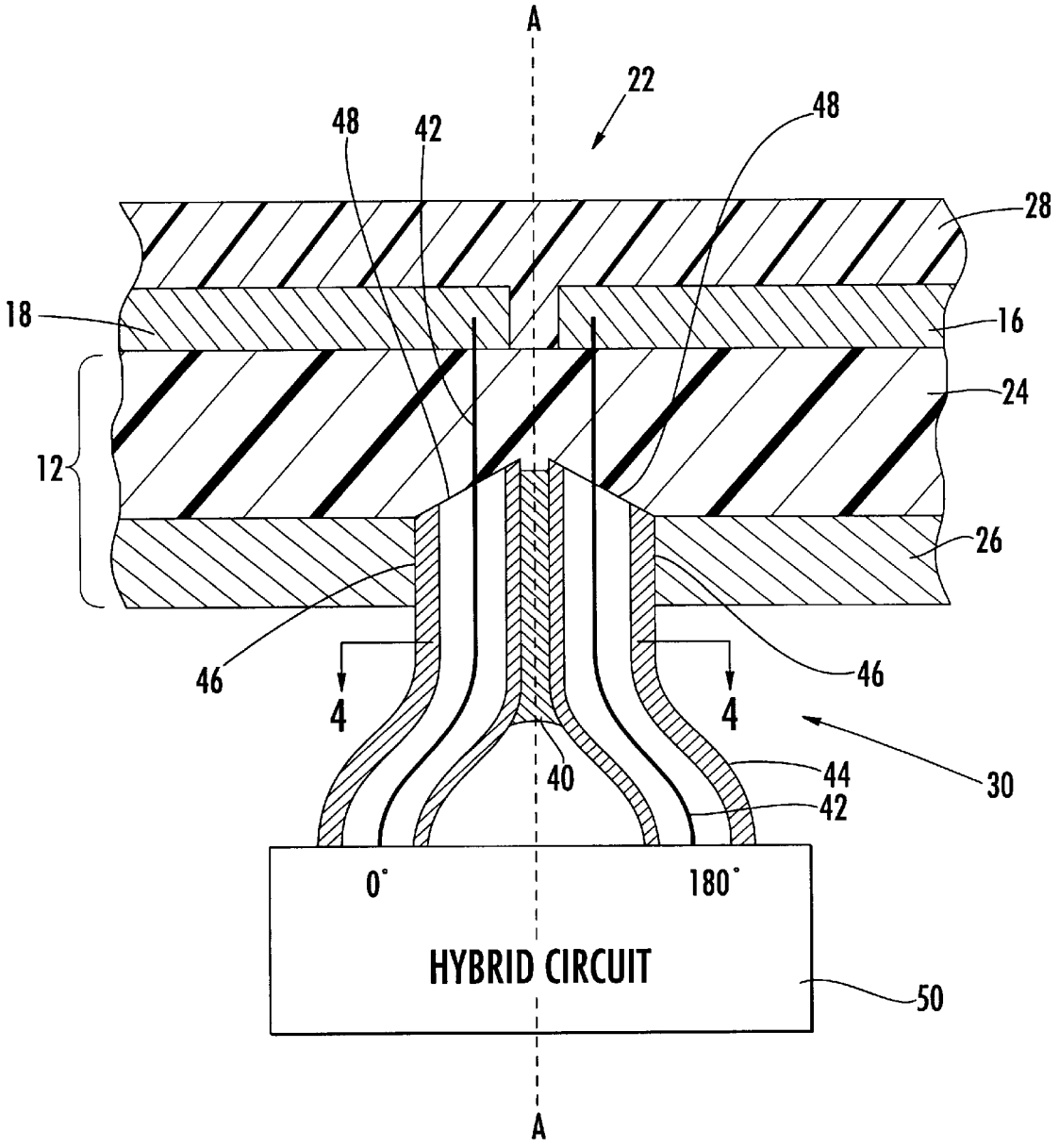
FIG. 2 is a cross-sectional view of the antenna including the feed structure taken along the line 2—2 in FIG. 1.
Figure 4:
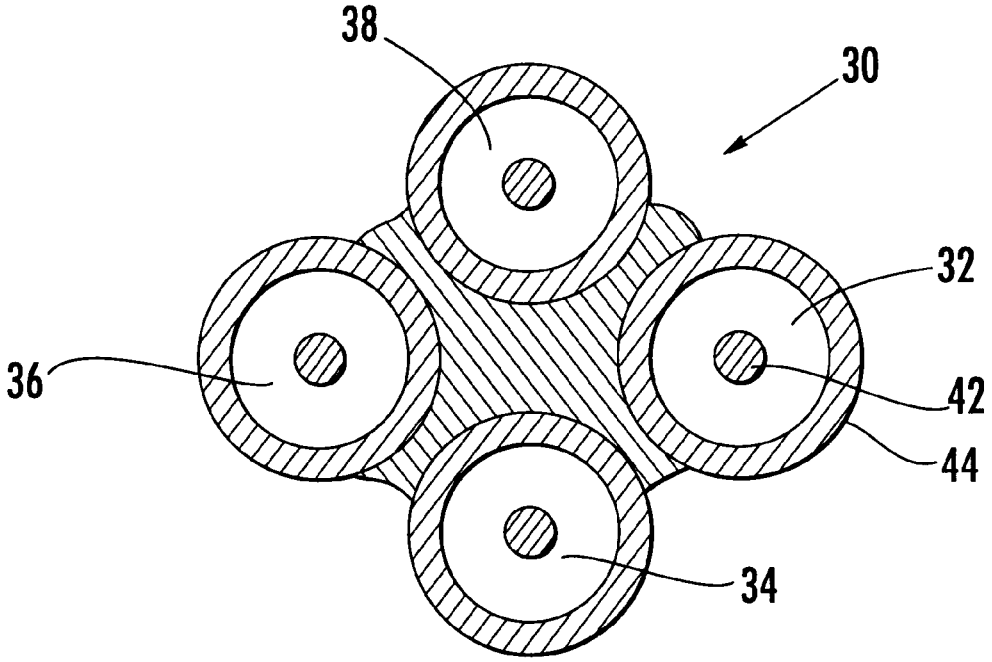
FIG. 4 is a cross-sectional view of the joinedtogether coaxial feed lines of the antenna taken along the line 4—4 in FIG. 2.

Each antenna unit also includes an antenna feed structure 30 having four coaxial feed lines 32, 34, 36, 38 (FIG. 4). Each coaxial feed line has an inner conductor 42 and a tubular outer conductor 44 in surrounding relation thereto. Referring to FIG. 2, the outer conductors 44 have parallel adjacent ends 46 joined together about an axis A—A and are connected to the ground plane 26. For example, the parallel adjacent ends 46 are joined together via solder 40. The ends 46 of the outer conductors 44 are tapered and arranged so that portions 48 thereof adjacent the axis A—A extend further beyond the ground plane 26 in the dielectric layer 24 and toward the antenna elements 14, 16, 18, 20. The inner conductors 42 preferably extend outwardly from the ends 46 of respective outer conductors 44, through the dielectric layer 24 and are connected to respective antenna elements 14, 16, 18, 20 adjacent the central feed position 22.

Preferably, the ends 46 of the outer conductors are symmetrically angled, and all of the antenna elements 14, 16, 18, 20 have a same shape, e.g. generally rectangular or a generally square shape. This reduces the common modes which would typically be associated with this type of array. The ground plane 26 may extend laterally outwardly beyond a periphery of the antenna units 13, and the coaxial feed lines 32, 34, 36, 38 may diverge outwardly from contact with one another upstream from the central feed position 22 as can be seen in FIG. 2.

The antenna 10 may also include at least one hybrid circuit 50 carried by the substrate 12 and connected to the antenna feed structure 30. The hybrid circuit 50 controls, receives and generates the signals to respective antenna elements 14, 16, 18, 20 of the antenna units 13 as would be appreciated by those skilled in the art.

Figure 3:
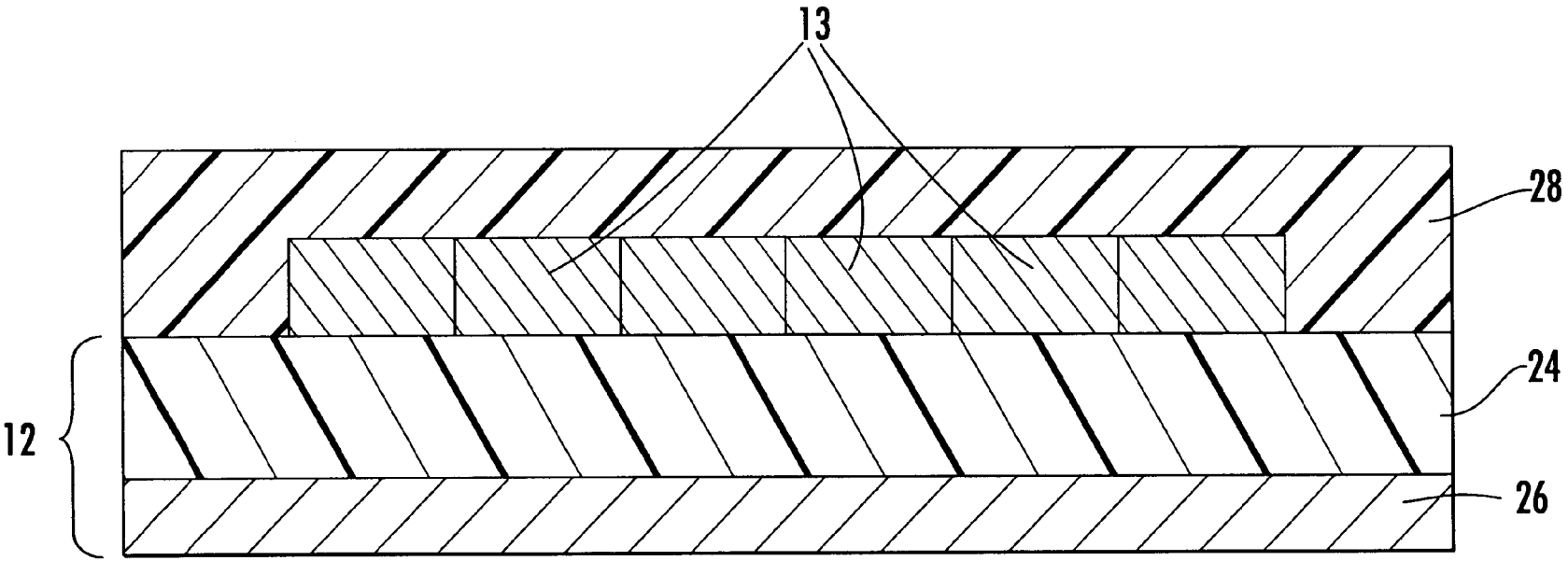
FIG. 3 is a cross-sectional view of the ground plane, dielectric layer, antenna units and impedance matching dielectric layer of the antenna taken along the line 3—3 in FIG. 1.

The dielectric layer preferably has a thickness in a range of about ½ an operating wavelength of the antenna 10, and at least one impedance matching dielectric layer 28 may be provided over the antenna units 13. This impedance matching dielectric layer 28 may also extend laterally outwardly beyond a periphery of the antenna units 13 as shown in FIG. 3. The use of the extended substrate 12 and extended impedance matching dielectric layer 28 result in an antenna bandwidth of 2:1 or greater. The substrate 12 is flexible and can be conformally mounted to a rigid surface, such as the nose-cone of an aircraft or spacecraft.

An aspect of the present invention includes a method of making the antenna 10 including forming the substrate :12 having a ground plane 26 and a dielectric layer 24 adjacent thereto, and providing at least one antenna unit 13 on the substrate. As discussed above, the antenna 10, as shown in FIG. 1, includes nine antenna untis 13 arranged in an array. Providing the antenna unit 13 includes arranging four adjacent antenna elements 14, 16, 18, 20 in spaced apart relation from one another about the central feed position 22 on the dielectric layer 24 opposite the ground plane 26, and forming the antenna feed structure 30 including four coaxial feed lines 32, 34, 36, 38 each having an inner conductor 42 and a tubular outer conductor 44 in surrounding relation thereto. The outer conductors 44 have parallel adjacent ends 46.

Forming the antenna feed structure 30 further includes joining together the parallel adjacent ends 46 of the outer conductors 44 about an axis A—A, connecting the parallel adjacent ends of the outer conductors to the ground plane 26, tapering and arranging the parallel adjacent ends of the outer conductors so that portions 48 thereof adjacent the axis extend further beyond the ground plane in the dielectric layer 24 and toward the antenna elements 14, 16, 18, 20, and connecting the inner conductors 42 to respective antenna elements adjacent the central feed position 22. As discussed above, the inner conductors 42 extend outwardly from the parallel adjacent ends 46 of respective outer conductors 44. Furthermore, the parallel adjacent ends 46 of the outer conductors 44 are preferably joined together about an axis A—A via solder 40.

The method also includes providing the at least one hybrid circuit 50 on the substrate 12 and connected to the antenna feed structure 30. Furthermore, the method may include providing at least one impedance matching dielectric layer 28 to cover the antenna units 13, and which extends laterally outwardly beyond a periphery of the at least one antenna unit, as shown in FIG. 3.

The antenna 10 has a two to one bandwidth in the frequency range of 2–28 Ghz, achieves a scan angle of ±45°, and has return loss of less than or equal to about 10 db. Thus, a lightweight patch dipole phased array antenna 10 with a wide frequency bandwith and a wide scan angle is provided. Also, the antenna 10 is flexible and can be conformally mountable to a surface.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A dual polarization antenna comprising:

a substrate comprising a ground plane and a dielectric layer adjacent thereto;

at least one antenna unit carried by said substrate and comprising four adjacent antenna elements arranged in spaced apart relation from one another about a central feed position on said dielectric layer opposite said ground plane, diagonal pairs of antenna elements defining respective antenna dipoles thereby providing dual polarization, and an antenna feed structure comprising four coaxial feed lines, each coaxial feed line comprising an inner conductor and a tubular outer conductor in surrounding relation thereto, said outer conductors having parallel adjacent ends joined together about an axis and connected to said ground plane, the ends of said outer conductors being tapered and arranged so that portions thereof adjacent the axis extend further beyond said ground plane in said dielectric layer and toward said antenna elements, said inner conductors extending outwardly from ends of respective outer conductors, through said dielectric layer and being connected to respective antenna elements adjacent the central feed position.

2. A dual polarization antenna according to claim 1 wherein the ends of said outer conductors are symmetrically angled.

3. A dual polarization antenna according to claim 1 wherein all of said antenna elements have a same shape.

4. A dual polarization antenna according to claim 1 wherein said ground plane extends laterally outwardly beyond a periphery of said at least one antenna unit.

5. A dual polarization antenna according to claim 1 wherein said coaxial feed lines diverge outwardly from contact with one another upstream from said central feed position.

6. A dual polarization antenna according to claim 1 further comprising at least one hybrid circuit carried by said substrate and connected to said antenna feed structure.

7. A dual polarization antenna according to claim 1 wherein each antenna element has a generally rectangular shape.

8. A dual polarization antenna according to claim 1 wherein each antenna element has a generally square shape.

9. A dual polarization antenna according to claim 1 wherein said at least one antenna unit comprises plurality of antenna units arranged in an array.

10. A dual polarization antenna according to claim 1 wherein said dielectric layer has a thickness in a range of about ½ an operating wavelength of the antenna.

11. A dual polarization antenna according to claim 1 at least one impedance matching dielectric layer on said at least one antenna unit.

12. A dual polarization antenna according to claim 11 wherein said at least one impedance matching dielectric layer extends laterally outwardly beyond a periphery of said at least one antenna unit.

13. A dual polarization antenna according to claim 1 wherein said substrate is flexible.

14. An antenna comprising:

a substrate comprising a ground plane and a dielectric layer adjacent thereto;

at least one antenna unit carried by said substrate and comprising four adjacent antenna elements arranged in spaced apart relation from one another about a central feed position on said dielectric layer opposite said ground plane, and an antenna feed structure comprising four coaxial feed lines, each coaxial feed line comprising an inner conductor and a tubular outer conductor in surrounding relation thereto, said outer conductors having parallel adjacent ends joined together about an axis and connected to said ground plane, the ends of said outer conductors being tapered and arranged so that portions thereof adjacent the axis extend further beyond said ground plane in said dielectric layer and toward said antenna elements, said inner conductors extending outwardly from ends of respective outer conductors and being connected to respective antenna elements adjacent the central feed position.

15. A dual polarization antenna according to claim 14 wherein the ends of said outer conductors are symmetrically angled.

16. A dual polarization antenna according to claim 14 wherein all of said antenna elements have a same shape.

17. A dual polarization antenna according to claim 14 wherein said ground plane extends laterally outwardly beyond a periphery of said at least one antenna unit.

18. A dual polarization antenna according to claim 14 wherein said coaxial feed lines diverge outwardly from contact with one another upstream from said central feed position.

19. A dual polarization antenna according to claim 14 further comprising at least one hybrid circuit carried by said substrate and connected to said antenna feed structure.

20. A dual polarization antenna according to claim 14 wherein each antenna element has a generally rectangular shape.

21. A dual polarization antenna according to claim 14 wherein each antenna element has a generally square shape.

22. A dual polarization antenna according to claim 14 wherein said at least one antenna unit comprises a plurality of antenna units arranged in an array.

23. A dual polarization antenna according to claim 14 wherein said dielectric layer has a thickness in a range of about ½ an operating wavelength of the antenna.

24. A dual polarization antenna according to claim 14 further comprising at least one impedance matching dielectric layer on said at least one antenna unit.

25. A dual polarization antenna according to claim 24 wherein said at least one impedance matching dielectric layer extends laterally outwardly beyond a periphery of said at least one antenna unit.

26. A dual polarization antenna according to claim 14 wherein said substrate is flexible.

27. A method of making an antenna comprising:

forming a substrate comprising a ground plane and a dielectric layer adjacent thereto;

providing at least one antenna unit on the substrate by arranging four adjacent antenna elements in spaced apart relation from one another about a central feed position on the dielectric layer opposite the ground plane, and forming an antenna feed structure comprising four coaxial feed lines, each coaxial feed line comprising an inner conductor and a tubular outer conductor in surrounding relation thereto, the outer conductors having parallel adjacent ends, wherein forming the antenna feed structure further comprises joining together the parallel adjacent ends of the outer conductors about an axis, connecting the parallel adjacent ends of the outer conductors to the ground plane, tapering and arranging the parallel adjacent ends of the outer conductors so that portions thereof adjacent the axis extend further beyond the ground plane in the dielectric layer and toward the antenna elements, and connecting the inner conductors to respective antenna elements adjacent the central feed position, the inner conductors extending outwardly from the parallel adjacent ends of respective outer conductors.

28. A method according to claim 27 wherein the ends of the outer conductors are symmetrically angled.

29. A method according to claim 27 wherein all of the antenna elements have a same shape.

30. A method according to claim 27 wherein the ground plane extends laterally outwardly beyond a periphery of the at least one antenna unit.

31. A method according to claim 27 wherein said coaxial feed lines diverge outwardly from contact with one another upstream from the central feed position.

32. A method according to claim 27 further comprising providing at least one hybrid circuit on the substrate and connected to the antenna feed structure.

33. A method according to claim 27 wherein each antenna element has a generally rectangular shape.

34. A method according to claim 27 wherein each antenna element has a generally square shape.

35. A method according to claim 27 wherein providing the at least one antenna unit comprises arranging a plurality of antenna units in an array.

36. A method according to claim 27 wherein the dielectric layer has a thickness in a range of about ½ an operating wavelength of the antenna.

37. A method according to claim 27 further comprising providing at least one impedance matching dielectric layer on the at least one antenna unit.

38. A method according to claim 37 wherein the at least one impedance matching dielectric layer extends laterally outwardly beyond a periphery of the at least one antenna unit.

39. A method according to claim 27 wherein the substrate is flexible.

* * * * *